US010935929B2

(12) United States Patent
Tanaka et al.

(10) Patent No.: US 10,935,929 B2
(45) Date of Patent: Mar. 2, 2021

(54) IMAGE FORMING APPARATUS

(71) Applicants: Tomoya Tanaka, Kanagawa (JP); Shoji Asanuma, Kanagawa (JP); Taiga Shoen, Kanagawa (JP); Yoshihide Ohta, Tokyo (JP); Akimitsu Obana, Kanagawa (JP); Makoto Kikura, Kanagawa (JP)

(72) Inventors: Tomoya Tanaka, Kanagawa (JP); Shoji Asanuma, Kanagawa (JP); Taiga Shoen, Kanagawa (JP); Yoshihide Ohta, Tokyo (JP); Akimitsu Obana, Kanagawa (JP); Makoto Kikura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/566,183

(22) Filed: Sep. 10, 2019

(65) Prior Publication Data

US 2020/0103823 A1 Apr. 2, 2020

(30) Foreign Application Priority Data

Sep. 28, 2018 (JP) ..... JP2018-183250

(51) Int. Cl.
*G03G 21/20* (2006.01)
*G03G 15/00* (2006.01)

(52) U.S. Cl.
CPC ..... *G03G 21/206* (2013.01); *G03G 15/6573* (2013.01); *G03G 2215/0043* (2013.01);
(Continued)

(58) Field of Classification Search
CPC ..... G03G 21/206; G03G 15/6573; G03G 2215/0043; G03G 2215/00333;
(Continued)

(56) References Cited

U.S. PATENT DOCUMENTS

2010/0054791 A1 3/2010 Shimizu
2010/0158557 A1* 6/2010 Kuroda ..... G03G 21/206 399/92

(Continued)

FOREIGN PATENT DOCUMENTS

JP 2008-132649 6/2008
JP 2010-054578 3/2010

(Continued)

*Primary Examiner* — Ryan D Walsh
(74) *Attorney, Agent, or Firm* — Harness, Dickey & Pierce P.L.C.

(57) ABSTRACT

An image forming apparatus includes an image forming device; a fixing device; a first conveyance passage downstream from the fixing device in a sheet conveyance direction; a second conveyance passage downstream from the fixing device and communicating with the first conveyance passage; a sheet reversing member to reverse a conveyance direction of the sheet to the second conveyance passage; a divider to switch a route of the sheet between the first conveyance passage and the second conveyance passage; and a sheet detection sensor disposed downstream from the fixing device and upstream from the divider. The first conveyance passage includes a sheet outlet from which the sheet is ejected outside the apparatus. The apparatus further includes a ventilation passage communicating with an outside, to guide air from the outside to pass the sheet detection sensor and enter at least one of the first conveyance passage and the second conveyance passage.

13 Claims, 6 Drawing Sheets

(52) U.S. Cl.
CPC ..... *G03G 2215/00333* (2013.01); *G03G 2215/00556* (2013.01); *G03G 2215/00603* (2013.01); *G03G 2221/1645* (2013.01)

(58) Field of Classification Search
CPC ..... G03G 2215/00556; G03G 2215/00603; G03G 2215/0679; G03G 2221/1645
See application file for complete search history.

(56) References Cited

U.S. PATENT DOCUMENTS

| | | | | |
|---|---|---|---|---|
| 2011/0103809 | A1* | 5/2011 | Kuwata ..... | G03G 15/234 399/16 |
| 2016/0109841 | A1 | 4/2016 | Horita et al. | |
| 2016/0378042 | A1 | 12/2016 | Tanaka et al. | |
| 2019/0227478 | A1 | 7/2019 | Kikura et al. | |

FOREIGN PATENT DOCUMENTS

| | | |
|---|---|---|
| JP | 2014-115368 | 6/2014 |
| JP | 2014-219562 | 11/2014 |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application No. 2018-183250, filed on Sep. 28, 2018, in the Japan Patent Office, the entire disclosure of which is incorporated by reference herein.

BACKGROUND

Technical Field

This disclosure generally relates to an image forming apparatus such as a copier, a facsimile machine, a printer, or a multifunction peripheral (MFP) having at least two of copying, printing, facsimile transmission, plotting, and scanning capabilities.

Description of the Related Art

Conventionally, for an image forming apparatus such as a copier or a printer, a technology has been known in which air passes a downstream side of a fixing device and is then discharged to the outside of the apparatus for the purpose of discharging heat generated by the fixing device to the outside of the apparatus.

SUMMARY

According to an embodiment of this disclosure, an image forming apparatus includes an image forming device; a fixing device; a first conveyance passage downstream from the fixing device in a sheet conveyance direction; a second conveyance passage downstream from the fixing device and communicating with the first conveyance passage; a sheet reversing member to reverse a conveyance direction of the sheet to the second conveyance passage; a divider to switch a conveyance route of the sheet between the first conveyance passage and the second conveyance passage; and a sheet detection sensor disposed downstream from the fixing device and upstream from the divider. The first conveyance passage includes a sheet outlet from which the sheet is ejected outside the image forming apparatus. The apparatus further includes a ventilation passage communicating with an outside, to guide air from the outside to pass the sheet detection sensor and enter at least one of the first conveyance passage and the second conveyance passage.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
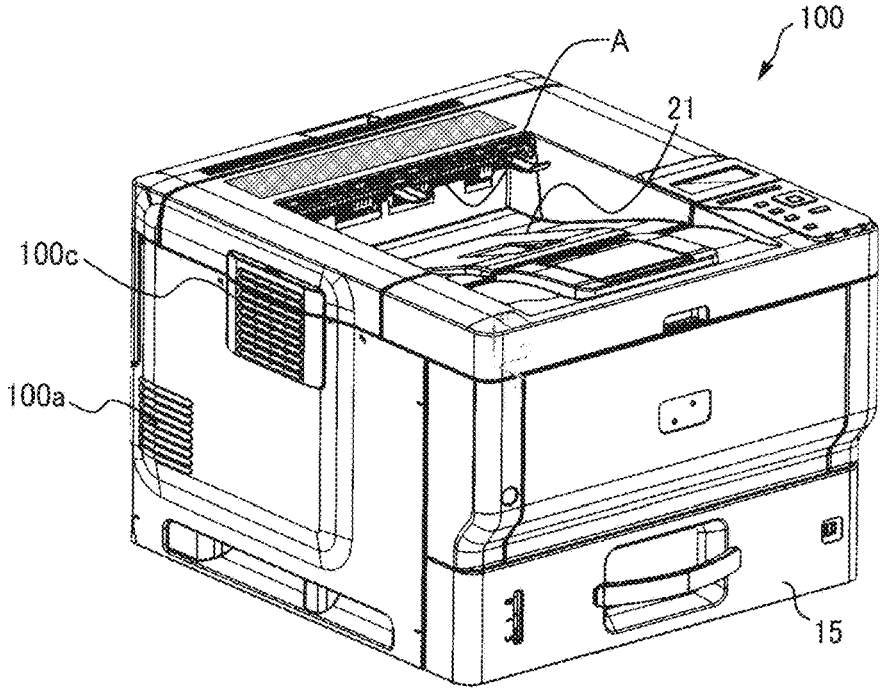
FIG. 1 is a perspective view illustrating an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First, an overall configuration and operation of an image forming apparatus 100 according to an embodiment of this disclosure is described with reference to FIGS. 1 to 3.

Figure 2:
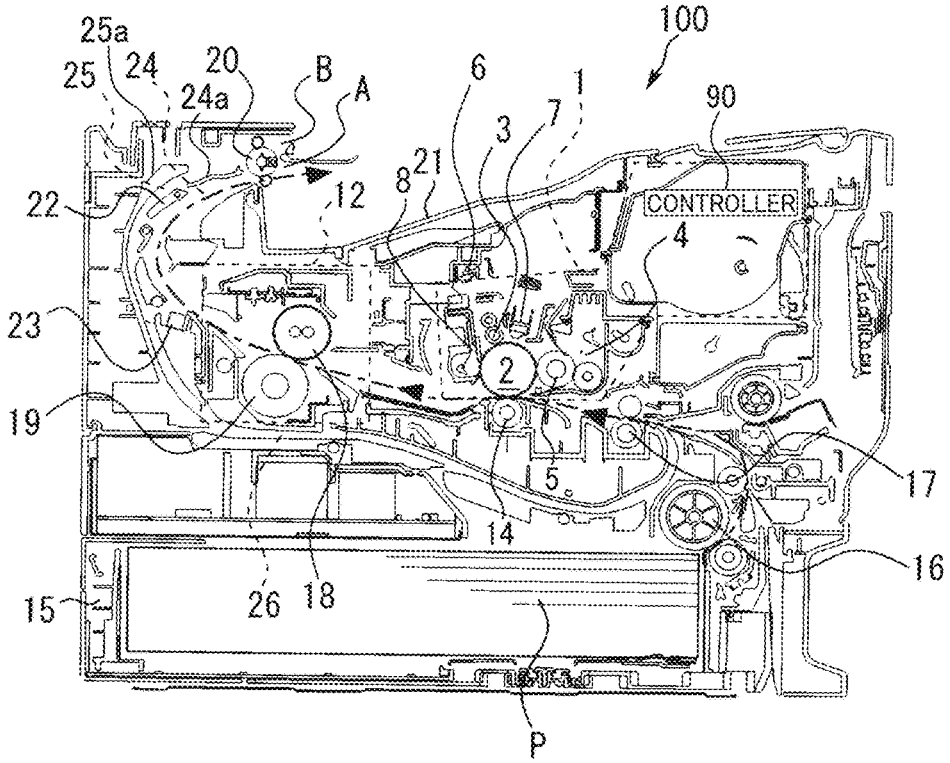
FIG. 2 is a view illustrating a configuration of an image forming apparatus.
Figure 3:
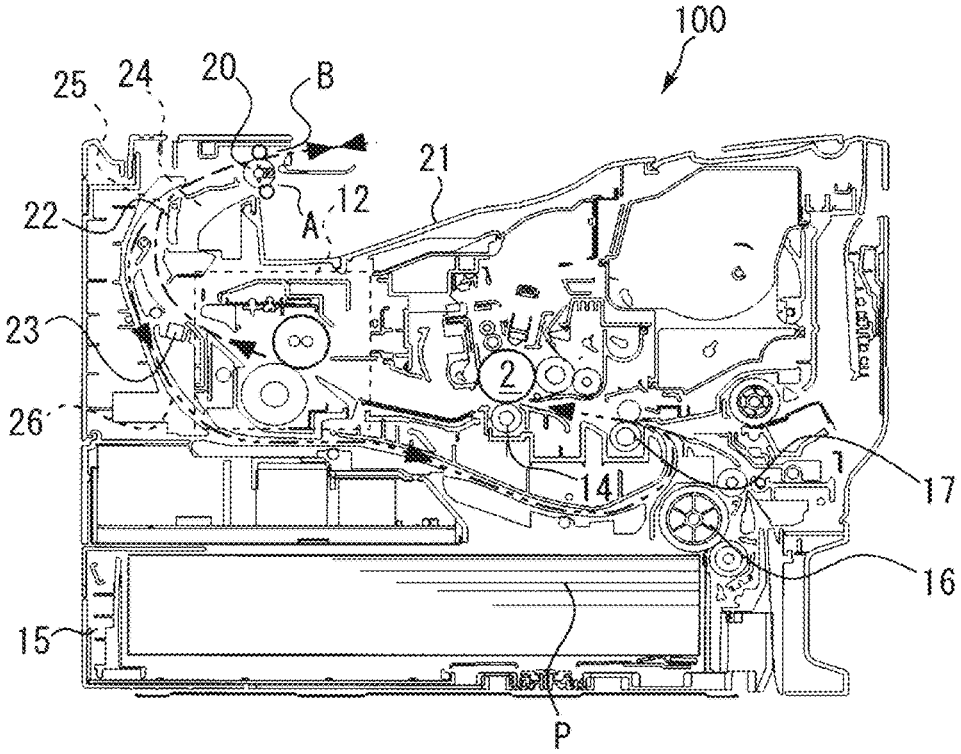
FIG. 3 is a view illustrating routes in which a sheet passes a second conveyance passage and a double-sided conveyance passage in the image forming apparatus illustrated in FIG. 1.

FIG. 1 is a schematic perspective view illustrating an image forming apparatus 100 according to the present embodiment, and FIGS. 2 and 3 are schematic cross-sectional views thereof.

The image forming apparatus 100 according to the present embodiment is a monochrome laser printer.

As illustrated in FIG. 2, in the image forming apparatus 100, a process cartridge 1 for forming an image with a black toner (developer) is detachably (replaceably) installed.

The process cartridge 1 is a unit integrally including a photoconductor 2 (photoconductor drum), which is an image bearer, that bears an image (toner image) on the surface, a charging roller 3 (charging unit) that charges the surface of the photoconductor 2, a developing unit 4 that supplies a toner (developer) and forms an image on the photoconductor 2, a cleaning unit 8 that cleans the surface of the photoconductor 2, and an electric eliminating unit 6 that eliminates electricity from the surface of the photoconductor 2.

In the image forming apparatus 100, an exposure device 7 is provided above the photoconductor 2 of the process cartridge 1. The exposure device 7 emits exposure light (laser light) in a main scanning direction to the surface of the photoconductor 2 rotating in a clockwise direction of FIG. 2 on the basis of image data input to the image forming apparatus 100 from a personal computer or the like and forms an electrostatic latent image corresponding the image data on the photoconductor 2.

A transfer roller 14 (transfer unit) is provided below the photoconductor 2 of the process cartridge 1. The transfer roller 14 is in contact with the photoconductor 2 and forms a transfer nip (image forming position) and transfers an image on the photoconductor 2 onto a sheet P conveyed to the transfer nip.

The process cartridge 1, the exposure device 7, the transfer roller 14 and the like function as an image forming device.

A paper feeding roller 16 for feeding the sheet P, e.g., paper stored in a paper feeding tray 15, is arranged in a lower part of the image forming apparatus 100. On a downstream side in the conveyance direction of the paper feeding roller 16 (downstream side in a direction in which the sheet P is conveyed), and on an upstream side in the conveyance direction of the transfer nip (image forming position), a timing roller 17 whereby the sheet P fed by the paper feeding roller 16 is once stopped and then conveyed at a predetermined timing is arranged.

On a downstream side in the conveyance direction of the transfer nip (image forming position), a fixing device 12 for heating and fixing the image formed on (transferred to) the surface of the sheet P. The fixing device 12 includes a fixing roller 18 containing a heating source, e.g., a halogen heater, and a pressure roller 19 that rotates in contact with the fixing roller 18 at a predetermined pressure.

A basic operation of the image forming apparatus 100 according to the present embodiment is described below with reference to FIG. 2.

First, when the paper feeding roller 16 is rotated according to a paper feeding signal from a control unit, an uppermost sheet P of sheets P stacked on the paper feeding tray 15 is separated and delivered to a sheet conveyance passage. The sheet P fed from the paper feeding tray 15 is conveyed in the arrow direction indicated by the dash-dotted line in FIG. 2. When the end of the paper P reaches the nip unit of the timing roller 17, the sheet P stands ready in a state where the sheet P is sagging in order to adjust the timing (synchronization) with the image (toner image) on the photoconductor 2 and correct an end skew of the sheet P. a At the image forming device, the photoconductor 2 is rotated in a clockwise direction of FIG. 2 by a drive mechanism and the photoconductor layer on the surface is charged by the charging roller 3 to a more uniform high potential. The surface of the charged photoconductor 2 is selectively exposed by the exposure device 7 on the basis of the image data, and an electrostatic latent image including a low potential portion where the potential has been decayed by the exposure and a high potential portion due to initialization is formed. Next, when the surface of the photoconductor 2 on which the electrostatic latent image is formed reaches the position opposite a developing roller 5 of a developing unit 4, the toner is transferred from the developing roller 5 where a toner thin layer is formed on the surface and the toner image is formed (developed).

Then, when the surface of the photoconductor 2 on which the toner image is formed reaches the transfer nip (image forming position), the sheet P standing ready at the position of the timing roller 17 adjusts the timing (synchronization) by the rotation of the timing roller 17 and is conveyed to the transfer nip. Thus, the toner image on the photoconductor 2 is transferred by the transfer roller 14 to the sheet P delivered to the transfer nip. Note that the residual toner on the photoconductor 2 that could not be transferred to the sheet P is cleaned up by a cleaning blade that contacts the photoconductor 2 at the position of a cleaning unit 8. The surface potential of the cleaned surface of the photoconductor 2 is cleared at the position of the electric eliminating unit 6, and the photoconductor 2 is ready for formation of a next toner image.

The sheet P to which the toner image has been transferred by the transfer nip (image forming position) is further conveyed in the direction indicated by the dashed line and reaches the position of the fixing device 12. Then, the sheet P conveyed to the fixing device 12 is sandwiched between the fixing roller 18 and the pressure roller 19, and the image (unfixed toner image) borne on the surface is heated and pressurized so as to be fixed (this is a fixing process). The sheet P on which the image has been fixed is delivered from the fixing device 12.

After receiving the fixing process in the fixing device 12, as indicated by the dash-dotted line arrow in FIG. 2, the sheet P passes by a sheet detection sensor 23. Then, the sheet P passes through a first conveyance passage 24 (a discharge passage), and a discharge and reverse roller 20 (a reversing member) discharges the sheet from a discharge port A (a sheet outlet) to the outside of the image forming apparatus 100, that is, onto the output tray 21. At this time, as illustrated in FIG. 2, a switch member 22 (a divider or a branching guide member) closes a second conveyance passage 25 (a reverse passage) adjacent to the first conveyance passage 24 and rotates to a position where the first conveyance passage 24 is opened.

That is, the first conveyance passage 24 (the discharge passage) extends from the switch member 22 to the discharge port A, and the second conveyance passage 25 (the reverse passage) communicates, via the switch member 22, with the first conveyance passage 24.

Note that the conveyance route of the sheet P extending from the fixing device 12 via the first conveyance passage 24 (the discharge passage) to the outside of the image forming apparatus 100 is for one-sided printing or for back-side printing in double-sided printing.

In contrast, for front-side printing of double-sided printing, the sheet P after the fixing process on the front side is not conveyed to the first conveyance passage 24 (discharge passage), but conveyed to the second conveyance passage 25 (reverse passage) for preparation of printing on the back side as illustrated in FIG. 3. An operation of the image forming apparatus 100 for double-sided printing is described below with reference to FIG. 3.

As illustrated in FIG. 3, when image formation is performed on the front side (first side) for double-sided printing, the switch member 22 (branch guide member) closes the first conveyance passage 24 (discharge passage) and rotates to a position where the second conveyance passage 25 (reverse passage) is opened.

The switch member 22 rotates to a position of FIG. 3 when the reverse (reverse in conveyance direction) of the sheet P is necessary for double-sided printing at the timing when a predetermined time elapses since start of the conveyance of the sheet P that has stood ready at the position of the timing roller 17 to the transfer nip, and the switch member 22 rotates to a position of FIG. 2 when reverse of the sheet P is not necessary.

The sheet P after the fixing process on the front side for double-sided printing passes the position of the sheet detection sensor 23 and is then guided to the second conveyance passage 25 (reverse passage) by the switch member 22 that has rotated to the position of FIG. 3. Then, the sheet P conveyed to the second conveyance passage 25 reaches the position of the discharge and reverse roller 20. Then, the rear end of the sheet P passes the position of the switch member 22 and the entire sheet P is accommodated in the second conveyance passage 25. Then, the discharge and reverse roller 20 that has rotated forward is switched to reverse rotation, thereby reversing the conveyance direction of the sheet P. At this time, the switch member 22 rotates to return to the position FIG. 2 and is brought into a state where a double-sided conveyance passage 26 is opened when viewed from the second conveyance passage 25. Then, the sheet P conveyed in the second conveyance passage 25 in a state where the conveyance direction is reversed is conveyed toward the double-sided conveyance passage 26 linked to the second conveyance passage 25.

Thus, the discharge and reverse roller 20 serves as a reversing member to reverse the conveyance direction of the sheet P and conveys the sheet P to the second conveyance passage. The reversing member is not limited to a roller but can be a belt or the like.

The discharge and reverse roller 20 is controlled for reverse timing (timing of reversing the rotation direction) by the sheet detection sensor 23 arranged on downstream from the fixing device 12 in the sheet conveyance direction and on an upstream side in the conveyance direction with respect to the switch member 22 (upstream side in the conveyance direction of the sheet P before reversed). Specifically, after a predetermined time (time obtained when margin is added to the conveyance time taken from the position of the sheet detection sensor 23 to the position of the switch member 22) elapses from the timing at which the rear end of the sheet P passes the position of the sheet detection sensor 23, the discharge and reverse roller 20 that had rotated forward is reversed.

In the second conveyance passage 25, an exposure port B for exposing part (front end side) of the sheet P that has passed the fixing device 12 and been conveyed to the outside of the image forming apparatus 100 is provided near the discharge and reverse roller 20. That is, a vicinity of the discharge and reverse roller 20 is open to expose an end of the first conveyance passage 24 and an end of the second conveyance passage 25 (discharge port A and exposure port B are formed). Therefore, even when a sheet P having a long size in the conveyance direction is not accommodated in the second conveyance passage 25, the reverse conveyance for the sheet P is possible without paper jam in such a way that the sheet P is conveyed so that an unaccommodated sheet portion is exposed (protrudes) to the outside from the exposure port B.

Then, the sheet P conveyed to the double-sided conveyance passage 26 from the second conveyance passage 25 (sheet P in a state where the conveyance direction has been reversed by the second conveyance passage 25 after the fixing process on the front side) is, as illustrated in the dash-dotted line arrow of FIG. 3, is conveyed toward the image forming position (transfer nip) via the double-sided conveyance passage 26. The sheet P guided to the transfer nip is subject to image formation on the back side of the sheet P at the position of the transfer nip by the same image formation process (image forming operation) as that described above. Then, after the fixing process at the fixing device 12, the sheet P is ejected from the image forming apparatus 100 via the first conveyance passage 24. Thus, the double-sided printed sheet P is stacked on the output tray 21.

A characterizing configuration and operation of the image forming apparatus 100 according to the present embodiment is described in detail below.

As described above with reference to FIGS. 2 and 3, the image forming apparatus 100 according to the present embodiment includes the fixing device 12, the first conveyance passage 24 (a discharge passage), the second conveyance passage 25 (a reverse passage), the double-sided conveyance passage 26 (a third conveyance passage), the switch member 22, the sheet detection sensor 23 (a detector).

The fixing device 12 heats and fixes an image (unfixed toner image) on the surface of the sheet P.

The first conveyance passage 24 is a conveyance passage in which the sheet P that has passed the fixing device 12 is conveyed and the sheet P is ejected to the outside of the image forming apparatus 100 through the discharge port A. The first conveyance passage 24 is formed of a conveyance guide member 24*a* (two opposing guide plates) that guides the sheet P.

The second conveyance passage 25 is a conveyance passage in which the sheet P that has passed the fixing device 12 is conveyed in a state where the conveyance direction is reversed. The second conveyance passage 25 is formed of a conveyance guide member 25a (two opposing guide plates) that guides the sheet P. The second conveyance passage 25 is partially adjacent to the first conveyance passage, and the conveyance guide member for that portion is shared by the first conveyance passage 24 and the second conveyance passage 25.

In the double-sided conveyance passage 26, the conveyance direction of the sheet P is reversed by the second conveyance passage 25 and the sheet P is conveyed toward the image forming position (transfer nip). The double-sided conveyance passage 26 is formed from a junction with the second conveyance passage 25 to a junction with the conveyance passage from the paper feeding tray 15 to the timing roller 17. The double-sided conveyance passage 26 is formed of a conveyance guide member (opposing two guide plates) that guides the sheet P.

The switch member 22 is a member for switching a passage for the sheet that has passed the fixing device 12 to one of the first conveyance passage 24 and the second conveyance passage 25. The switch member 22 is disposed at a branch portion between the first conveyance passage 24 and the second conveyance passage 25, and is configured to be rotatable in both forward and reverse directions about a support shaft extending in a direction perpendicular to the plane of the drawings of FIGS. 2 and 3.

The sheet detection sensor 23 is disposed on downstream from the fixing device 12 in the sheet conveyance direction and on an upstream side in the conveyance direction with respect to the switch member 22. The sheet detection sensor 23 is a reflective photosensor includes a light-emitting element and a light-receiving element, and a detection face thereof opposes the conveyance passage. The sheet detection sensor 23 optically detects the presence or absence of a sheet at that position of the conveyance passage.

Specifically, when the output of the sheet detection sensor 23 is on, it is determined that the sheet P is present. When the output of the sheet detection sensor 23 is off, it is determined that the sheet P is absent. The front end of the sheet P is detected at the timing when the output of the sheet detection sensor 23 is changed from off to on, and the rear end of the sheet P is detected at the timing when the output of the sheet detection sensor 23 is changed from on to off.

Alternatively, the sheet detection sensor 23 can have the following configuration. A light transmission portion is provided on the conveyance guide plate to secure a reflection light path from a light-emitting element to a light-receiving element of the sheet detection sensor 23 disposed on the back side of the conveyance guide plate. Yet alternatively, the sheet detection sensor 23 can employ the following configuration. A filler is disposed between the light-emitting element and the light-receiving element of the sheet detection sensor 23 disposed on the back side of the conveyance guide plate. Further, a cutout is formed on the conveyance guide plate so that an end of the filler protrudes to the conveyance passage via the cutout.

The sheet detection sensor 23 according to the present embodiment is arranged in the conveyance passage from the fixing device 12 to the switch member 22, and functions as a paper ejection detection sensor and functions as a reverse start sensor.

That is, based on detection results generated by the sheet detection sensor 23, a controller 90 of the apparatus determines whether the sheet P has been ejected through the discharge port A in the first conveyance passage 24 and determines the timing of reversing the sheet P in the second conveyance passage 25. The controller 90 controls switching operation (rotation direction or switch timing) of the switch member 22 based on results of the detection by the sheet detection sensor 23.

Specifically, in the case of one-sided printing (when an instruction of one-sided printing is input to the controller 90), based on the detection results of the sheet detection sensor 23, the controller 90 determines whether the sheet P has been normally conveyed to the first conveyance passage 24, without conveyance failure or the like (whether the sheet P has been ejected from the first conveyance passage 24). The switch member 22 remains rotated at the rotation position of the FIG. 2.

The controller 90 can be a processor including a central processing unit (CPU) and associated memory units such as a read only memory (ROM), a random access memory (RAM), etc. The processor performs various types of control processing by executing programs stored in the memory. For double-sided printing (when an instruction of double-sided printing is input to the control unit), the sheet detection sensor 23 detects whether the sheet P has been normally conveyed without conveyance failure or the like to the second conveyance passage 25 or the first conveyance passage 24, detects the rear end of the sheet P conveyed to the second conveyance passage 25, and determines the timing of switching from forward rotation to reverse rotation of the discharge and reverse roller 20 and the timing of returning the switch member 22 from the rotation position of FIG. 3 to the rotation position of FIG. 2. The switch member 22, at the timing when a predetermined time elapses since start of the conveyance of the sheet P standing ready at the position of the timing roller 17 to the transfer nip, is controlled to rotate to the rotation position of FIG. 3 when the sheet P after the fixing process on the front side (first side) is conveyed and to rotate to the rotation position of FIG. 2 when the sheet P after the fixing process on the back side (second side) is conveyed.

In the present embodiment, the sheet detection sensor 23 is arranged on a downstream side of the fixing device 12 and on an upstream side of the switch member 22. Therefore, as compared with the case where the sheet detection sensor is disposed in the first and second conveyance passages 24 and 25, which are on a downstream side of the switch member 22, the apparatus can be reduced in cost and size (space saving). The sheet detection sensor 23 arranged in such a position includes a function as a plurality of sensors including a paper ejection detection sensor and a reverse start sensor and thus can ensure stable conveyance of the sheet P in the first and second conveyance passages 24 and 25 that are branched on the downstream side of the fixing device 12.

The sheet detection sensor 23 arranged in the vicinity of the fixing device 12 and on the downstream side of the fixing device 12 quickly detects paper jam defect in which the sheet P is wound on the fixing roller 18 (or pressure roller 19) at the fixing device 12, so as to enable stop of sheet conveyance. Therefore, the degree of the sheet P wound on the fixing roller 18 or the like can be relatively reduced, facilitating subsequent paper jam removal.

In contrast, as in the present embodiment, when the sheet detection sensor 23 is arranged on a downstream side of the fixing device 12 and on an upstream side of the switch member 22, as compared with the case where the sheet detection sensor is disposed in the first and second conveyance passages 24 and 25 on a downstream side of the switch member 22, failures (malfunction of element, heat deformation of filler, or the like) are likely to occur in the sheet detection sensor 23, which is an electronic component, due to the influence of heat generated at the fixing device 12, which is a heat source.

In particular, in the case of a small-sized apparatus disposed on a table like the image forming apparatus 100 according to the present embodiment, the conveyance passage from the fixing device 12 to the switch member 22 is short, and the sheet detection sensor 23 becomes closer to the fixing device 12. Thus, the aforementioned disadvantage becomes prominent.

Figure 4:
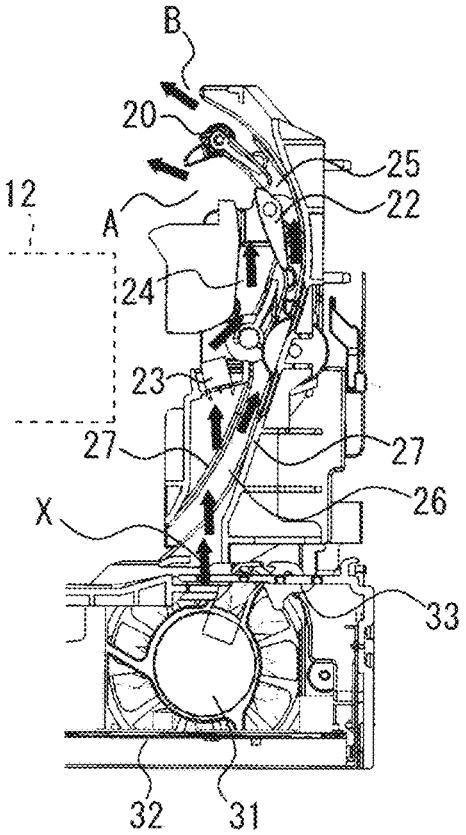
FIG. 4 is a view illustrating a ventilation passage.
Figure 7:
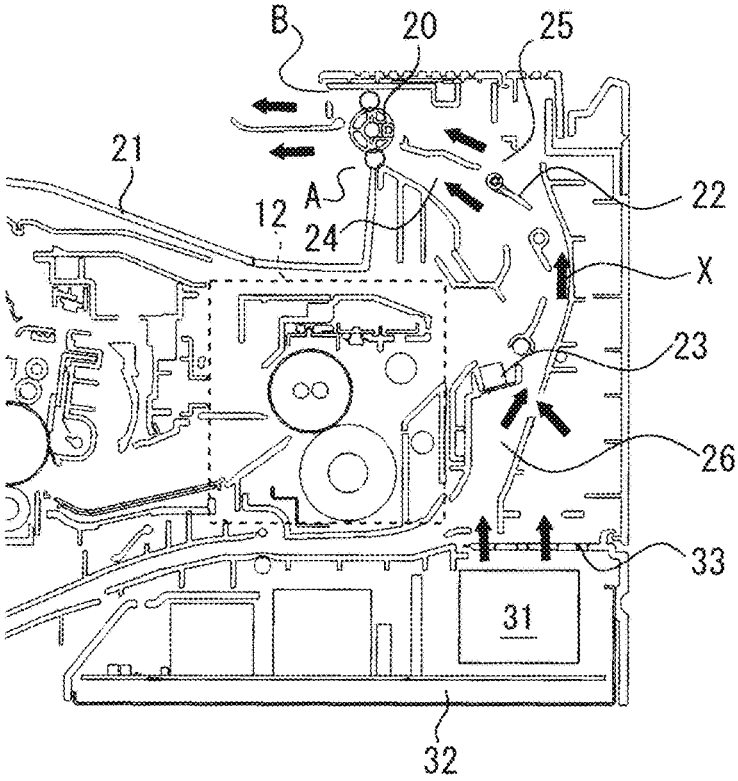
FIG. 7 is a view illustrating a main part of an image forming apparatus.

In order to prevent such defects, the image forming apparatus 100 according to the present embodiment includes a cooling ventilation passage X illustrated in FIGS. 4 and 7. Specifically, as illustrated in FIGS. 4 and 7, the image forming apparatus 100 includes the ventilation passage X in which air introduced into the image forming apparatus 100 from the outside passes through a post-fixing section and passes at least one of the first conveyance passage 24 and the second conveyance passage 25 (in the present embodiment, both the first and second conveyance passages 24 and 25). The post-fixing section is downstream from the fixing device 12 in the conveyance direction and includes the sheet detection sensor 23.

The ventilation passage X includes the discharge port A of the first conveyance passage 24 as a vent to discharge the air to the outside of the image forming apparatus 100. Furthermore, the ventilation passage X also includes the exposure port B of the second conveyance passage 25 as a vent to discharge the air to the outside of the image forming apparatus 100.

That is, the image forming apparatus 100 includes the ventilation passage X in which the air flows in the direction indicated by the black arrow in FIGS. 4 and 7.

Thus, even when the sheet detection sensor 23 is arranged near the fixing device 12 as described above, the air introduced from the outside cools the sheet detection sensor 23. Thus, failure of the sheet detection sensor 23 due to the heat can be prevented.

The ventilation passage X according to the present embodiment passes the downstream side of the fixing device 12. Therefore, the sheet P, which has high temperature, delivered from the fixing device 12 after the fixing process is also cooled and a user who picks up the sheet P immediately after paper ejection hardly feels heat and the heat generated on the downstream side of the fixing device 12 is also released to the outside of the apparatus. The inside of the apparatus is less likely to be overheated.

Furthermore, in the present embodiment, a dedicated exhaust duct or exhaust fan is not provided to discharge the air that has passed the downstream side of the fixing device 12 to the outside of the apparatus, but the existing first and second conveyance passages 24 and 25 for sheet conveyance are used as discharge passages. Therefore, it is possible to prevent an increase in size and cost of the apparatus.

The ventilation passage X is described in more details below.

Referring to FIGS. 4 and 7, in the image forming apparatus 100 according to the present embodiment, a suction fan 31 (cooling fan) for cooling a power supply board 32 (a component to be protected from heat) is disposed below the double-sided conveyance passage 26. The suction fan 31 introduces the ambient air to prevent the power supply board 32 from being heated. The ambient air is introduced into the apparatus through an air intake 100*a* (see FIG. 1) provided on a side face of the housing of the image forming apparatus 100.

Figure 5:
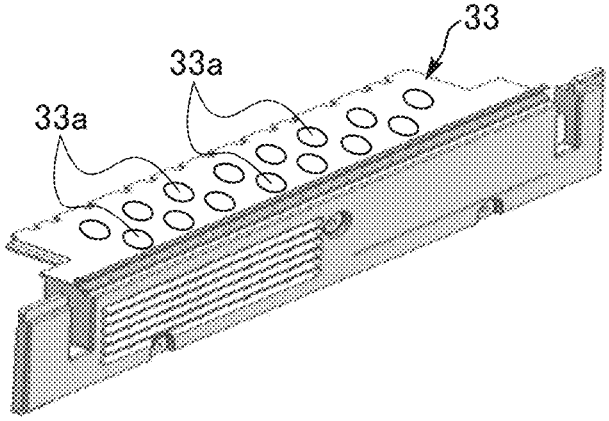
FIG. 5 is a perspective view illustrating a protective cover.
Figure 6A:
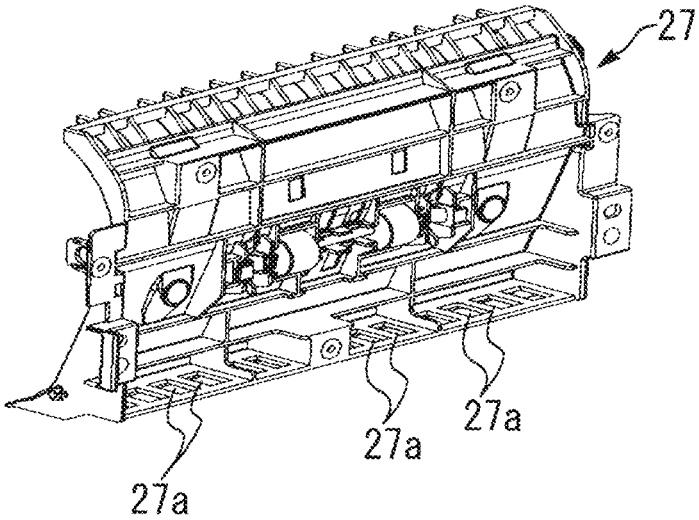
FIGS. 6A and 6B are perspective views illustrating a conveyance guide member from different angles.
Figure 6B:
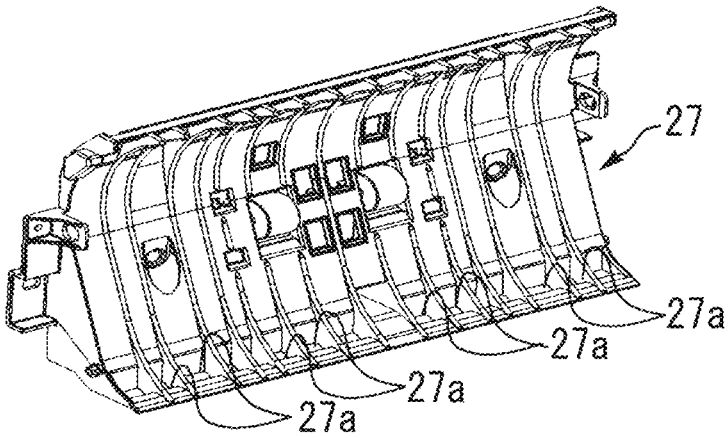

Moreover, also referring to FIG. 5, because entry of a foreign material into the power supply board 32 is a cause of failure, a protective cover 33 for preventing entry of a foreign material is disposed at an upper part of the power supply board 32. As illustrated in FIG. 5, the protective cover 33 partially includes a plurality of openings 33*a*, enabling flow of the air sent from the suction fan 31 to the upper portion. Moreover, a conveyance guide member 27 (double-sided conveyance guide member) of the double-sided conveyance passage 26 is disposed at the upper part of the protective cover 33. As illustrated in FIGS. 6A and 6B, the conveyance guide member 27 also includes an opening 27*a* for ventilation. That is, the double-sided conveyance passage 26 is provided with the conveyance guide member 27 that guides the sheet P and includes the opening 27*a* to let the air in the ventilation passage X to pass.

When the openings 33*a* and 27*a* are formed on the protective cover 33 and the conveyance guide member 27 as described above, the ambient air introduced from the suction fan 31 flows from the upper part of the protective cover 33 to the conveyance guide member 27 and further flows from the opening 27*a* of the conveyance guide member 27 to the double-sided conveyance passage 26 as indicated by the black arrow in FIG. 7. The ambient air that has flown to the double-sided conveyance passage 26 passes the downstream side of the fixing device 12 and cools the sheet detection sensor 23. Then, the ambient air is ejected to the outside of the apparatus through the discharge port A or the exposure port B via the first and second conveyance passages 24 and 25.

In the present embodiment, the ventilation passage X is configured to guide the air from the outside of the image forming apparatus 100 to pass, via a cooled section, through the post-fixing section including the sheet detection sensor 23, downstream from the fixing device 12 in the sheet conveyance direction. The cooled section is different from the fixing device 12 and includes the power supply board 32 (the component to be protected from heat) in the present embodiment.

Thus, as compared with the case where a dedicated suction fan (cooling fan) or intake duct for cooling the post-fixing section including the sheet detection sensor 23 and being downstream from the fixing device 12, the apparatus is reduced in size (space saving) and cost.

In the present embodiment, as illustrated in FIGS. 5 and 6, the openings 33*a* and 27*a* are formed on the protective cover 33 and the conveyance guide member 27 (double-sided conveyance guide member). However, in order to ensure the ventilation passage X, an opening through which the air of the ventilation passage X passes may be formed on the conveyance guide member of at least one of the first conveyance passage 24 and the second conveyance passage 25 as necessary.

Variation 1

Figure 8A:
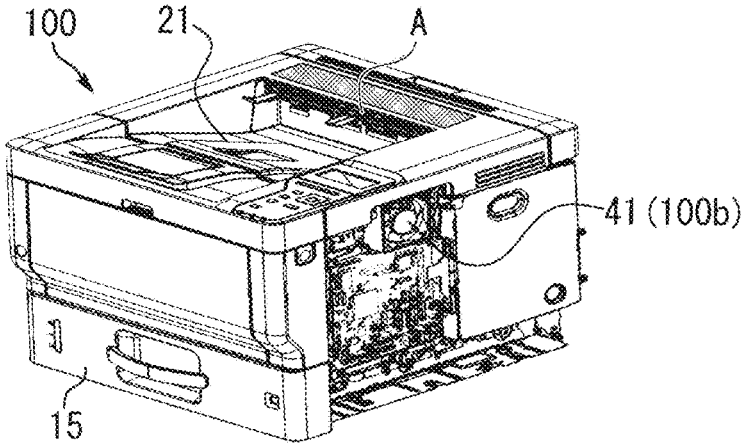
FIGS. 8A and 8B are perspective views illustrating an image forming apparatus of Variation 1.
Figure 8B:
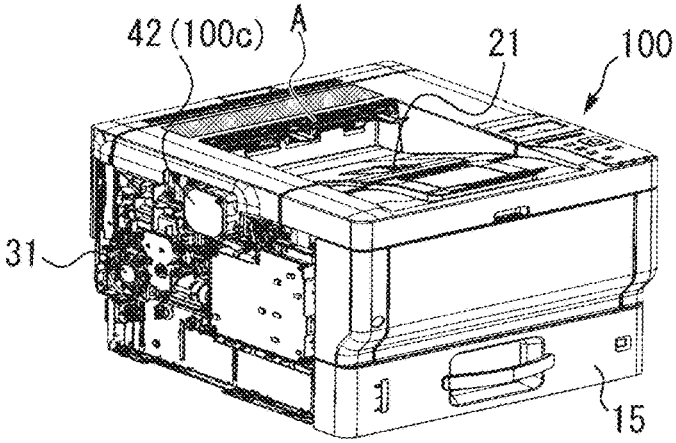
Figure 9:
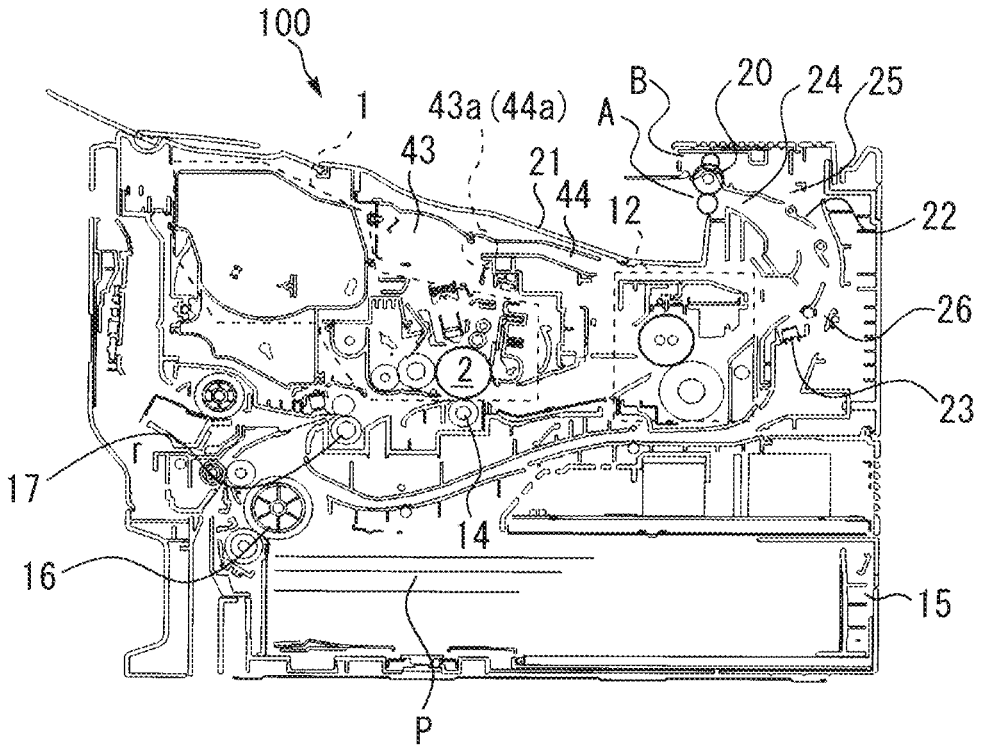
FIG. 9 is a view illustrating a configuration of illustrating the image forming apparatus of FIGS. 8A and 8B.
Figure 10:
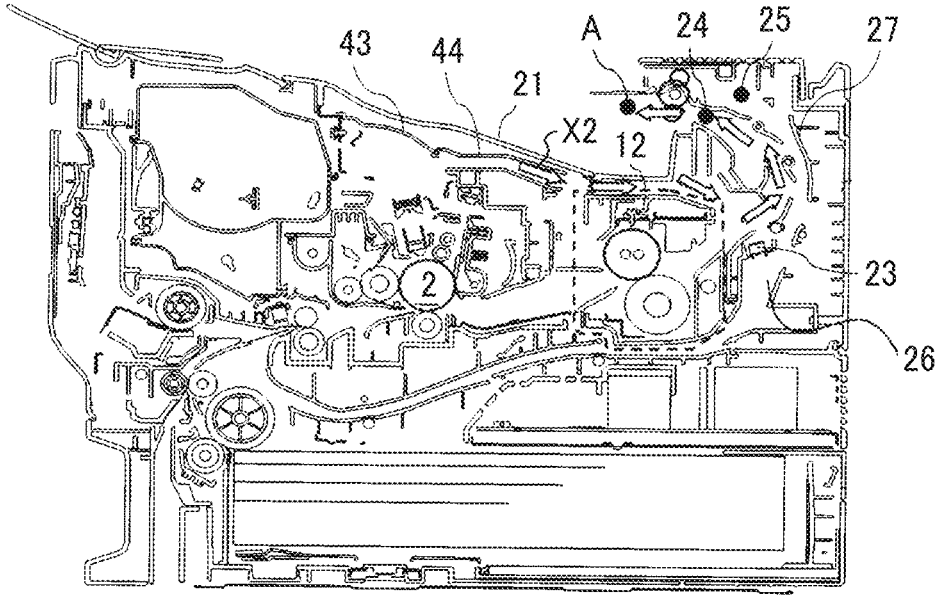
FIG. 10 is a view illustrating a ventilation passage formed in the image forming apparatus of FIG. 9.

FIGS. 8A and 8B are perspective views illustrating an image forming apparatus 100 of Variation 1 from different angles, illustrating a state where a part of the body cover is removed. Moreover, FIG. 9 is a schematic cross-sectional view illustrating the image forming apparatus 100. FIG. 10 is a view illustrating a ventilation passage X2 formed in the image forming apparatus 100.

As illustrated in FIGS. 8 to 10, similar to the ventilation passage X according to the present embodiment, the ventilation passage X2 of Variation 1 is configured such that the air introduced from the outside to the inside passes a portion different from the fixing device 12 and then passes the position of the downstream side of the fixing device 12. However, the ventilation passage X2 of Variation 1 differs the ventilation passage X according to the present embodiment in that the ventilation passage X2 in which the downstream side of the fixing device 12 is cooled by using the intake passage for cooling the image forming device, e.g., the process cartridge 1, is formed while the ventilation passage X in which the downstream side of the fixing device 12 is cooled by using the intake passage for cooling the power supply board 32 is formed.

Specifically, as illustrated in FIGS. 8A and 8B, the image forming apparatus 100 of Variation 1 includes two suction fans 41 and 42 for cooling the image forming device. The suction fans 41 and 42 are to cool the image forming device in order to prevent a temperature rise in the apparatus due to increases in speed of the apparatus or adherence of the toner to the image forming device when a low melting point toner is used. The suction fans 41 and 42 are fans that introduce the ambient air into the apparatus through air intake 100b and 100c formed on a side of the apparatus.

As illustrated in FIG. 9, at an upper part of the image forming device (the process cartridge 1), a duct 43 for efficient cooling of the interior of the apparatus is provided. The duct 43 is configured such that the air sent into the apparatus flows to a desired location without being diffused. A communication port 43*a* is formed on the exhaust side of the duct 43, and a communication port 44 on the intake side of a further duct 44 is communicated with the opening 43*a*.

In the image forming apparatus 100 according to the present embodiment, the fixing device 12 and the output tray 21 are close and there is a possibility that the output tray 21 becomes hot due to the heat generated at the fixing device 12. In contrast, according to Variation 1, such defect is less likely to occur because the duct 44 is provided between the fixing device 12 and the output tray 21 such that this portion is cooled.

According to Variation 1, as indicated by the white arrow in FIG. 10, the air sucked by the suction fans 41 and 42 arranged on both sides of the apparatus flows above the fixing device 12 via the ducts 43 and 44, flows to the downstream side of the fixing device 12 to cool the sheet detection sensor 23, and is then ejected to the outside of the apparatus through the discharge port A and the exposure port B via the first and second conveyance passages 24 and 25.

Similarly, when the ventilation passage X2 is configured in the above manner, the same effect as the present embodiment can be obtained.

Variation 2

Figure 11:
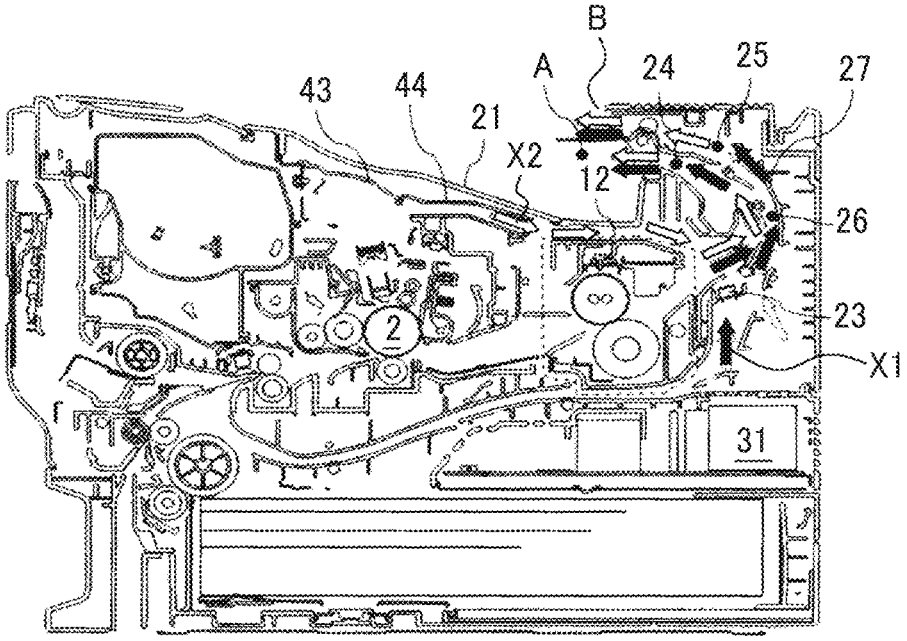
FIG. 11 is a view illustrating a ventilation passage formed in an image forming apparatus of Variation 2.

FIG. 11 is a view illustrating ventilation passages X1 and X2 formed in the image forming apparatus 100 of Variation 2.

The ventilation passages X1 and X2 of Variation 2 use an intake passage for cooling the power supply board 32 (intake passage of the ventilation passage X according to the present embodiment) and an intake passage for cooling the image forming device (intake passage of the ventilation passage X2 of Variation 1) to form the ventilation passages X1 and X2 that cool the downstream side of the fixing device 12.

That is, the ventilation passages X1 and X2 of Variation 2 are configured such that the air introduced from the outside to the inside of the image forming apparatus 100 via a plurality of air intakes 100*a* to 109*c* (suction fans 31, 41, and 42) passes the post-fixing section including the sheet detection sensor 23 and passes the first and second conveyance passages 24 and 25.

According to Variation 2, the sheet detection sensor 23 arranged in the middle of the conveyance passage from the junction at which the intake passage (intake passage of the ventilation passage X according to the present embodiment) for cooling the power supply board 32 and the intake passage (intake passage of the ventilation passage X2 of Example 1) for cooling the image forming device join to the position of the switch member 22.

Similarly, when the ventilation passages X1 and X2 are configured in the above manner, the same effect as the present embodiment can be obtained. In particular, according to Variation 2, the air introduced from the two intake passages cools the downstream side of the fixing device 12 including the sheet detection sensor 23. Therefore, the cooling efficiency is further increased.

As described above, in the image forming apparatus 100 according to the present embodiment, the switch member 22 that switches a passage for the sheet P that has passed the fixing device 12 to one of the first conveyance passage 24 (discharge passage) and the second conveyance passage 25 (reverse passage) is disposed, and the sheet detection sensor 23 that detects the presence or absence of the sheet P is disposed on the downstream side in the conveyance direction with respect to the fixing device 12 and on the upstream side in the conveyance direction with respect to the switch member 22 is disposed. Furthermore, the ventilation passage X in which the air introduced from the outside to the inside of the image forming apparatus 100 passes the position of the post-fixing section including the sheet detection sensor 23 (downstream from the fixing device 12 in the conveyance direction) and passes at least one of the first conveyance passage 24 and the second conveyance passage 25 is provided.

Thus, the introduced air can pass the downstream side of the fixing device 12 and can be ejected to the outside of the apparatus, and the sheet P is stably conveyed in the first and second conveyance passages 24 and 25 branching on the downstream side of the fixing device 12 without an increase in size and cost of the image forming apparatus 100.

In the present embodiment, the ventilation passage X is configured such that the air introduced from the outside to the inside of the image forming apparatus 100 passes the downstream section (including the sheet detection sensor 23) from the fixing device 12 in the conveyance direction and passes the first conveyance passage 24 and the second conveyance passage 25.

In contrast, the ventilation passage X may be configured such that the air introduced from the outside to the inside of the image forming apparatus 100 passes the downstream section (including the sheet detection sensor 23) from the fixing device 12 in the conveyance direction and passes the first conveyance passage 24 without passing the second conveyance passage 25. The ventilation passage X may be configured such that the air introduced from the outside to the inside of the image forming apparatus 100 passes the downstream section (including the sheet detection sensor 23) from the fixing device 12 in the conveyance direction and passes the second conveyance passage 25 without passing the first conveyance passage 24.

Similarly, in such cases, the same effect as the present embodiment can be obtained.

Note that the term "image forming apparatus" represents an apparatus configured to apply developer (toner) or ink onto a sheet serving as a recording medium, thereby forming an image on the sheet.

Further, the term "image formation" represents application, onto a recording medium, of not only a meaningful image such as a text and a figure but also a meaningless image, such as a pattern.

The term "sheet" includes not only paper but also any medium or document, such as an overhead projector (OHP) sheet and a textile, to which developer adheres. The term "sheet" is not limited to a plain paper but includes thick paper, a postcard, an envelope, thin paper, coated paper, art paper, and tracing paper.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

an image forming device configured to form an image on a sheet;

a fixing device configured to heat and fix the image on the sheet;

a first conveyance passage downstream from the fixing device in a sheet conveyance direction, the first conveyance passage including a sheet outlet from which the sheet is ejected to an outside of the image forming apparatus;

a second conveyance passage downstream from the fixing device in the sheet conveyance direction, the second conveyance passage communicating with the first conveyance passage;

a sheet reversing member configured to reverse a conveyance direction of the sheet and convey the sheet to the second conveyance passage;

a divider configured to switch a conveyance route of the sheet between the first conveyance passage and the second conveyance passage;

a cooled section including a board to be protected from heat;

a suction device configured to introduce air into the image forming apparatus via the cooled section;

a third conveyance passage between the suction device and the first and second conveyance passages;

a sheet detection sensor downstream from the fixing device and upstream from the divider in the sheet conveyance direction; and a ventilation passage communicating with the outside of the image forming apparatus and configured to guide the air introduced by the suction device into the third conveyance passage from the cooled section, to pass the sheet detection sensor and to enter at least one of the first conveyance passage and the second conveyance passage, and wherein the ventilation passage communicates with the sheet outlet and is configured to vent the air from the sheet outlet.

2. The image forming apparatus according to claim 1, wherein the second conveyance passage includes an exposure port configured to partly expose, to the outside, the sheet that has passed through the fixing device, and wherein the ventilation passage communicates with the exposure port and is configured to vent the air from the exposure port.

3. The image forming apparatus according to claim 1, further comprising:

a plurality of intakes provided in a housing of the image forming apparatus, wherein the ventilation passage is configured to guide the air from the plurality of intakes to pass a post-fixing section and enter at least one of the first conveyance passage and the second conveyance passage, the post-fixing section including the sheet detection sensor and being downstream from the fixing device in the sheet conveyance direction.

4. The image forming apparatus according to claim 1, wherein each of the first conveyance passage and the second conveyance passage includes a conveyance guide, and wherein the conveyance guide of at least one of the first conveyance passage and the second conveyance passage includes an opening to let the air in the ventilation passage to pass.

5. The image forming apparatus according to claim 1, further comprising:

circuitry configured to determine whether the sheet has been ejected from the first conveyance passage through the sheet outlet based on a detection result generated by the sheet detection sensor; and determine a timing of reversing the sheet in the second conveyance passage based on the detection result generated by the sheet detection sensor.

6. The image forming apparatus according to claim 1, further comprising:

circuitry configured to control a switching operation of the divider based on a detection result generated by the sheet detection sensor.

7. The image forming apparatus according to claim 1, wherein the third conveyance passage is configured to guide the sheet conveyed from the second conveyance passage toward the image forming device, the third conveyance passage including a conveyance guide including an opening to let the air in the ventilation passage to pass, and the conveyance guide is configured to guide the sheet.

8. The image forming apparatus according to claim 7, wherein the second conveyance passage includes an exposure port configured to partly expose, to the outside, the sheet that has passed through the fixing device, and wherein the ventilation passage communicates with the exposure port and is configured to vent the air from the exposure port.

9. The image forming apparatus according to claim 7, further comprising:

a plurality of intakes provided in a housing of the image forming apparatus, wherein the ventilation passage is configured to guide the air from the plurality of intakes to pass a post-fixing section and enter at least one of the first conveyance passage and the second conveyance passage, the post-fixing section including the sheet detection sensor and being downstream from the fixing device in the sheet conveyance direction.

10. The image forming apparatus according to claim 7, wherein each of the first conveyance passage and the second conveyance passage includes a conveyance guide, and wherein the conveyance guide of at least one of the first conveyance passage and the second conveyance passage includes an opening to let the air in the ventilation passage to pass.

11. The image forming apparatus according to claim 7, further comprising:

circuitry configured to determine whether the sheet has been ejected from the first conveyance passage through the sheet outlet based on a detection result generated by the sheet detection sensor; and determine a timing of reversing the sheet in the second conveyance passage based on the detection result generated by the sheet detection sensor.

12. The image forming apparatus according to claim 7, further comprising:

circuitry configured to control a switching operation of the divider based on a detection result generated by the sheet detection sensor.

13. The image forming apparatus according to claim 7, further comprising:

a third conveyance passage configured to guide the sheet conveyed from the second conveyance passage toward the image forming device, the third conveyance passage including a conveyance guide including an opening to let the air in the ventilation passage to pass, the conveyance guide configured to guide the sheet.

* * * * *